United States Patent [19]

Kelly

[11] 4,042,481

[45] Aug. 16, 1977

[54] PRESSURE-ELECTROLYSIS CELL-UNIT

[76] Inventor: Donald A. Kelly, 58-06 69th Place, Maspeth, N.Y. 11378

[21] Appl. No.: 536,268

[22] Filed: Dec. 24, 1974

[51] Int. Cl.[2] ..... C25B 1/02; C25B 1/12; C25B 11/03

[52] U.S. Cl. ..... 204/270; 204/129; 204/273; 204/278; 204/284

[58] Field of Search ..... 204/129, 270, 273, 278, 204/284, 204, 277, 275

[56] References Cited

U.S. PATENT DOCUMENTS

| | | | |
|---|---|---|---|
| 2,070,612 | 2/1937 | Niederreither | 204/129 X |
| 2,273,795 | 2/1942 | Heise | 204/277 X |

*Primary Examiner*—Arthur C. Prescott

[57] ABSTRACT

The advanced pressure electrolysis cell-(APEC Project) combines a conventional electrolysis function with the applying of external pressure on the enclosed water/electrolyte for accelerated gas passage through the permeable tubular electrode walls.

The key feature of the P/E cell unit is in combining the usual electrolysis electrodes with porous permeable metal to allow controlled gas passage through the electrode tubes under a pressure differential between the electrolyte zone and the gas passage zone.

A hydrophobic plastic coating is required over the porous electrode tubes to prevent water seepage, and minimize pore clogging due to the pressurized electrolyte.

The electrodes may be made in the form of tubes, discs or plates to allow for the construction of various forms of cell configuration.

A low frequency vibratory input is provided for the cell/unit to give a "sieving effect" to the gas molecules, as they permeate through the electrode walls.

9 Claims, 6 Drawing Figures

PRESSURE-ELECTROLYSIS CELL-UNIT

BACKGROUND OF THE INVENTION

The present state of the electrolysis art is not commercially attractive for large scale hydrogen production because the cost of the electrical input energy ranges between 75% to 85% of the fuel value of the released hydrogen and oxygen gases.

This electrical cost is prohibitively high, when the gases must, in turn, be burned as fuel for home heating, for heat engine application and for a wide variety of small industrial applications.

Various alternate hydrogen generation processes have been considered in the past, but none have shown sufficient future potential, compared to the basic water-/electrolysis method.

The dissociation of industrial ammonia has been considered, but in addition to the currently high cost of ammonia, the problems of a high heating source make this process less hopeful for further development effort.

The adaption of the active metal series (calcium, sodium, potassium, etc.) as a useful hydrogen generation means has been reviewed, but it was found that the necessary supporting equipment becomes too complex. In addition to a basic process tank, various material supply and holding tanks are required, along with the interconnection and control means.

Some of the other remaining possible hydrogen production processes would also involve extensive supporting equipment, raw materials, and considerable space/volume requirements, making them generally less desirable for further development for most applications.

The water electrolysis process is basically clean and simple for obtaining both pure hydrogen and oxygen, and moreover lends itself to various output improvement modifications, such as the applying of heat energy, internal and external pressure, sonic-vibration energy, light/radiant energy, chemical boosting, and the use of permeable electrodes in conjunction with pressure, and other possible variations and combinations of these means.

When the various forms of supplemental energy are considered, as applied to the electrolysis process, certain means stand-out as more economical and attractive than others. As a general rule, pressure and vibratory energy can be viewed as cheaper than heat and most forms of radiant energy, while chemical means are somewhat uncertain due to the initial and replenishment costs.

The use of permeable membranes or porous metallic elements for gas permeation through the electrodes of the cell entail some uncertain factors at this point in the development work, such as the probable progressive clogging of the permeable elements by the pressurized electrolyte, and the possible water/electrolyte leakage into the gas collection zones.

It is now believed that these negative factors ca be controlled and offset by the periodic reverse-flushing of the porous electrode elements in the first case, and by use of an effective hydrophobic coating material on the porous electrodes, in the latter instance.

Another obvious point in favor of the basic water electrolysis process, is that oxygen—(approx. 33%) is simultaneously produced along with the hydrogen gas—(67%), which can be used for combustion support of the ignited hydrogen gas in a modified I.C., or E. C. engine. For some applications this oxygen gas may not be used, and if not collected and stored in storage tanks, may be vented to the atmosphere.

The purpose of any electrolysis modification or combination method is to substitute some form of convenient low cost energy for a portion of the high-cost electrical input energy, for producing a given volume of hydrogen and oxygen.

The applying of pressure is not new in the electrolysis art, since the known and used Noeggerath Cell employs a cell configuration of progressively confined spaces, which results in a gradual pressure rise as the gases are generated. By careful, planned construction of the cells, the gradual pressure rise can continued until a final pressure of about 200 atmospheres is obtained.

While the Noeggerath Cells utilize progressively increasing internal pressure this present disclosure employs the applying of external pressure, acting on permeable electrode elements for accelerated permeation passage of both gases, unlike previous pressure type electrolysis cells.

The permeable pressure passage of gases is not new to the fuel cell art, in which some types of units employ permeable elements to allow the active gases to pass through them to generate electricity. A fuel cell provides an inverse function compared to an electrolysis cell, whereby an oxidant along with other fuels are introduced into the cell to generate electrical power.

Separation of hydrogen by permeation is known in the gas separation art, but previous separation methods have required the use of palladium, or palladium-silver alloys as the permeable barriers, which is now economically unacceptable for any commercial application.

A fine coating of palladium-black has been successfully used as a means of reducing the tendancy toward the "poisoning" of the permeable elements with an oxide film, but this advancement does not overcome the basic cost objection to the use of palladium or palladium metal alloys and heavy coatings.

The limited use of palladium and palladium-black film foruse in this invention for hydrogen permeable elements poses a specific difficulty in preventing electrode pore clogging, which must be overcome by the combined use of a near-surface plastic hydrophobic coating material, and the periodic reverse-flushing of the porous electrode tubular walls.

Although nickel and monel were the prime choices, and are now in use as the porous electrode material, vanadium has a lattice structure which is compatible with the diffusion of atomic hydrogen through it.

In the preliminary stages of the cell development, silicone was naturally proposed as a suitable hydrophobic medium to be impregnated into the porous electrode walls, but it was found that the silicone was gradually displaced by the pressureized electrolyte, so that it was dropped from further use for the cells.

The necessity of a permanent hydrophobic barrier layer was evident, and Teflon was suggested and used as a permeable subcoating, although Teflon does not exhibit a particularly high permeability rate to gas passage.

Other permeable plastic materials are now being tried and lifetested such as polyethylene and polystyrene coatings, which show greater gas permeability rates.

Another theory, yet to be tested, is the "salient point concept" in which a great number of random high points are located on the porous tubular electrode outer surface, so that the gas molecules tend to gather at these points. The theory behind this concept is that the salient points will tend to break up clogging in the local area of the points, aided by the input vibratory motion.

SUMMARY OF THE INVENTION

The advanced pressure-electrolysis cell/unit, with combined electrolysis elements and permeable gas passage means, serve to improve the basic electrolysis process by on pressure on the electrolyte to cause accelerated gas passage through the porous tubular electrodes.

By constructing the conventional electrolysis electrodes as porous, tubular or flat, electrically-conductive elements, a combined pressure-electrolysis function can be realized, which will provide an increased hydrogen and oxygen production rate for a given fixed rate of low-voltage, D. C. electrical input to the cell-unit.

Each porous metallic, tubular electrode is polarized as the cathode-(hydrogen passage), and anode-(oxygen passage) for the electrolysis functioning of the cell-unit.

Each porous metallic, tubular electrode is polarized as the cathode-(hydrogen passage), and anode-(oxygen passage) for the electrolysis functioning of the cell-unit.

The sets of anode and cathode tubular or box-electrodes are lined up in rows within an electrolysis process plastic tank, with each electrode tube secured to a top insulated plate, near the top of each electrode tube. The top insulation plate matches and fits on top of the flanges of the process tank, and seals the tank from electrolyte spillage.

Positive and negative electrical connections are made to each anode and cathode porous electrode tube, respectively, to maintain the continuing electrolysis process.

A plastic process tank made of polyethylene or polypropylene may be used for low working pressures, but such tanks must be inerted and reenforced with fiberglas and steel stripping to resist sudden shocks and rough handling.

In the preferred arrangement of the combined process cell-unit, the hydrogen and oxygen gases flowing upward through the electrode tube inside diameters are collected in two horizontal manifold tubes, which are directly connected to each electrode tube, where they protrude above the top insulated plate.

The protruding portion of each electrode tube is sealed around the outer surface, so that no gas escapes before it enters each of the two manifold, horizontal collection tubes.

The two horizontal manifold tubes are connected to hydrogen and oxygen storage tanks by means of convenient lengths of tube lines, which are protected from damage by suitable re-enforcement. For some applications, the gas tubing lines may be directly connected to the gas application, -engine, burner or other load.

The process tank may be pressurized by an external air pump, which pressurizes the electrolyte to a range of approximately 5 psi to 15 psi, so that the electrolyte is forced onto each porous electrode tube to accelerate gas permeation thru the electrode tubes.

Another, convenient pressurizing means may be used which is a gravity actuated piston-weight acting in a vertical cylinder so that a constant pressure is applied to the electrolyte within the process tank. This arrangement has the advantage of providing an electrolyte reservoir within the vertical tube to replenish the electrolyte as it becomes depleted within the process tank.

The piston-weight may be manually or automatically reset to its maximum vertical height within the vertical reservoir cylinder, when electrolyte or make-up distilled water is added to the process tank of the cell-unit.

This is the simpliest type of high-density construction, which provides a convenient and easily built unit with ease of servicing and reverse-flushing when necessary. Each tubular electrode provides a relatively large surface area for exposure to the electrolyte, so that a high-density configuration is achieved.

An alternate construction would consist of sets of round or square porous metallic plates which are spaced and separated by an insulation ring or square spacer, made as a pressure-tight, sealed unit cell. The opposite plates are polarized as the anode and cathode of the unit cell, and gas sealed collection hoods are provided over the ends of each exposed disc or square plate.

Groups of unit cells will be joined together in tandem array, to provide a useful gas volume output, as in the preferred design arrangement.

In a preliminary design of the cell/-unit, sets of anode and cathode plastic riser tubes which contained the concentric porous electrode tubes were cross-connected by smaller plastic tubes. The electrolyte within the riser tubes and cross tubes freely circulated between the riser tubes and electrode tubes, so that electrical polarity was maintained.

While this arrangement provides a high density configuration, or large electrode surface area to electrolyte volume ratio, it is more complicated to construct and less reliable against electrolyte leakage because of the many individual joined and sealed tubing connections.

Each porous electrode tube is coated on its outside diameter with a hydrophobic sub-surface coating, such as Teflon, polystyrene, polyethylene or similar plastic material, which must penetrate to about 0.010 to 0.015 inch, and then the surface must be lightly scraped clean of the hydrophobic coating to expose most of the metallic surface of the electrode tube periphery.

The metallic surface of the electrode tubes must be exposed to the pressurized electrolyte in order to maintain electrical polarity and process continuity.

It may eventually be more desirable to coat the inside diameters of the multiple electrode tubes with the hydrophobic coating to provide more rapid gas molecule permeation through the electrode walls. The shortcoming of this approach is that the tendancy toward pore clogging is increased since there is more exposed porous wall area, before the hydrophobic film/layer is reached by the permeating gas flow.

A further evolution of the porous wall treating means is the coating of both the inside and outside diameters of each porous electrode tube with a sub-surface coating of plastic hydrophobic material, along with a mid-wall zone inclusion of silicone to preclude any water leakage through the walls.

This electrode wall treatment technique would have the advantage of implimenting the periodic reverse-flughing head, to insure that the amount, or volume of the clogging by the electrolyte particles is minimized.

At the present time there is no provision for automatic reverse flushing, so that the continuous gas production must be interrupted, and the process tank drained and the reverse flushing started. It may be possible to evolve an automatic reverse-flush arrangement, at a later date, so that gas production can be continuous.

An important element in the anti-clogging effort will be the applying of low-frequency vibration to the cell-/unit process tank which will keep the electrolyte constantly agitated, so that the minute particles within the electrolyte will not be concentrated at any one point.

Another technique which is now being concurrently developed is the mechanical and chemical treatment of the sodium hydroxide electrolyte to minimize minute particle size. The sodium hydroxide will be finely pulverized into a fine powder form and treated with a compatible chemical which will insure uniform particle dispersion within the electrolyte bath.

The porosity range for the cathode (hydrogen) electrode tubes has now been tentatively established as approx. 0.3 microns to −.5 microns max., for a permeation pressure range of 5 to 15 psi., which is the tentative cell/unit working pressure.

Since the basic criterion for the electrode tube porosity is the restriction of water leakage at this pressure range, and the uniform diffusion of the tiny hydrogen molecules through the porous metal walls, an extremely fine porous structure is required for these electrode porous tubes.

The porosity range for the anode (oxygen) electrode tubes is also tentatively established as approx. 1 micron to 10 microns, for the same working pressure, based on the increased oxygen molecule size in relation to the hydrogen molecule.

The included hydrophobic sub-surface coating will have a direct influence on the gas flow rate through the electrode tube walls and the working pressure range will serve to control the gas flow and gas yield rates for the cell/unit(s).

Since the lowest possible porosity rating for these porous electrode tubes is now being used, based on current technology, for this application, the only other working variables for the gas permeation rate, is the restriction rate of the sub-surface hydrophobic layer, the variation of the working pressure, and the possible use of vanadium metal for the cathode-(hydrogen) electrode tube metal.

The requirement for the functioning of the cathode porous tubes present more difficulties and few alternate options, than for the anode porous tubes, since the oxygen permeable porous tubes may utilize sandwiched construction, with a silicone rubber insert placed between two close-fitting porous tubes.

Since oxygen molecules readily pass through a silicone rubber membrane, it is only necessary to provide an outer electrically polarized element to attract the oxygen molecules. A thin inner porous tube must be included with the electrode tube assembly to keep the fragile silicone rubber tube in place, and supported against the pressure and gas flow through the tube assembly.

It is critical to the proper operation of the cell/unit that a constant gas flow rate balance be maintained between the cathode and anode porous electrode tubes—(H2O), so that the electrolyte solution is uniformly depleted and uniformly replenished.

It is of further importance that the electrolyte solution balance be maintained at a nearly constant percentage so that the electrolysis and caustic level is kept nearly constant.

The current estimate for the electrolyte solution is between 10% and 15%, and the maximum percent solution must not be exceeded, since this would cause undue deterioration of the electrode tube metal, and decreased service life.

The low-voltage, D. C. power supply for the cell/unit must be in the 2 to 3 volt range, with insulated connections made to each of the sets of cathode and anode electrode tubes, by way of a terminal block secured to the top of the insulation plate on top of the process tank.

A fluid inlet connection is provided at the top of the piston/-weight in the vertical reservoir cylinder, which allows for the entrance of distilled make-up water into the cell unit, as the water/electrolyte is slowly depleted.

A drain petcock or other suitable connection is built into the process tank, near one corner, to allow for the draining and cleaning of the tank, for periodic reverse flushing and the maintenance/-replacement of damaged or neutralized electrode tubes.

A pressure gauge must be sealed and fitted into the top insulation plate to monitor the pressure level within the process tank.

These components complete the cell unit assembly, with necessary joining hardware and sealants used where required.

It is a principal objective of this present invention to produce a new and improved pressure-electrolysis cell-/unit, which features significantly increased gas yield rates for a compariable rate of input electrical power.

It is a further objective of the invention to so improve the effective gas yield rate for this type of pressure electrolysis unit, so that new applications are opened up to its use, including automotive propulsion adaptation.

All other objectives of the invention have been previously described and defined in the background and summary description of the specifications.

It should be understood that design variations may be made in the detail features of the Advanced Pressure Electrolysis Cell & Unit, without departing from the spirit and scope of the invention, as specified.

A number of Disclosure Documents have been filed in the Office, which describe background, portions and specifics of this advanced Pressure Electrolysis Cell/-Unit.

DISCLOSURE DOCUMENTS:

1. No. 035598 — Pressure-Electrolysis Unit
2. No. 036341 — Pressure-Electrolysis Unit
3. No. 035458 — High Density-Vibro-Electrolysis Unit
4. No. 035456 — Phototrolysis Cell
5. No. 034993 — Vertical Pressuretrolysis Cell
6. No. 034910 — Pressuretrolysis Cell
7. No. 034717 — Pressuretrolysis of Water, for "on-board" vehicle hydrogen generation.

DESCRIPTION OF THE PREFERRED EMBODIMENT

Figure 1:
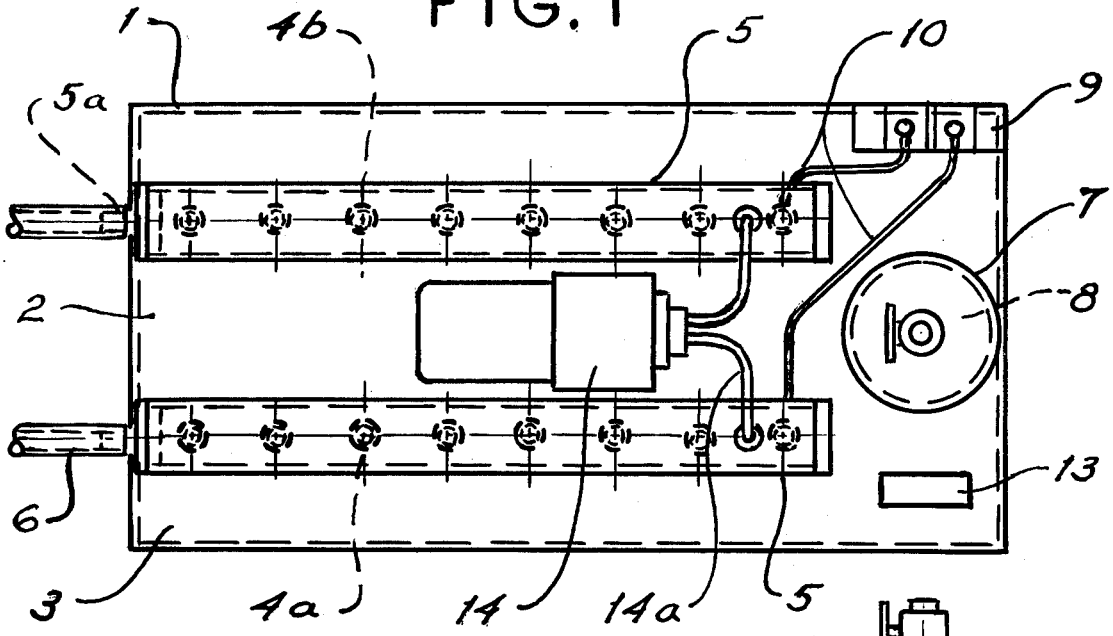
FIG. 1 is a top exterior view of the advanced Pressure-Electrolysis Cell/-Unit
Figure 2:
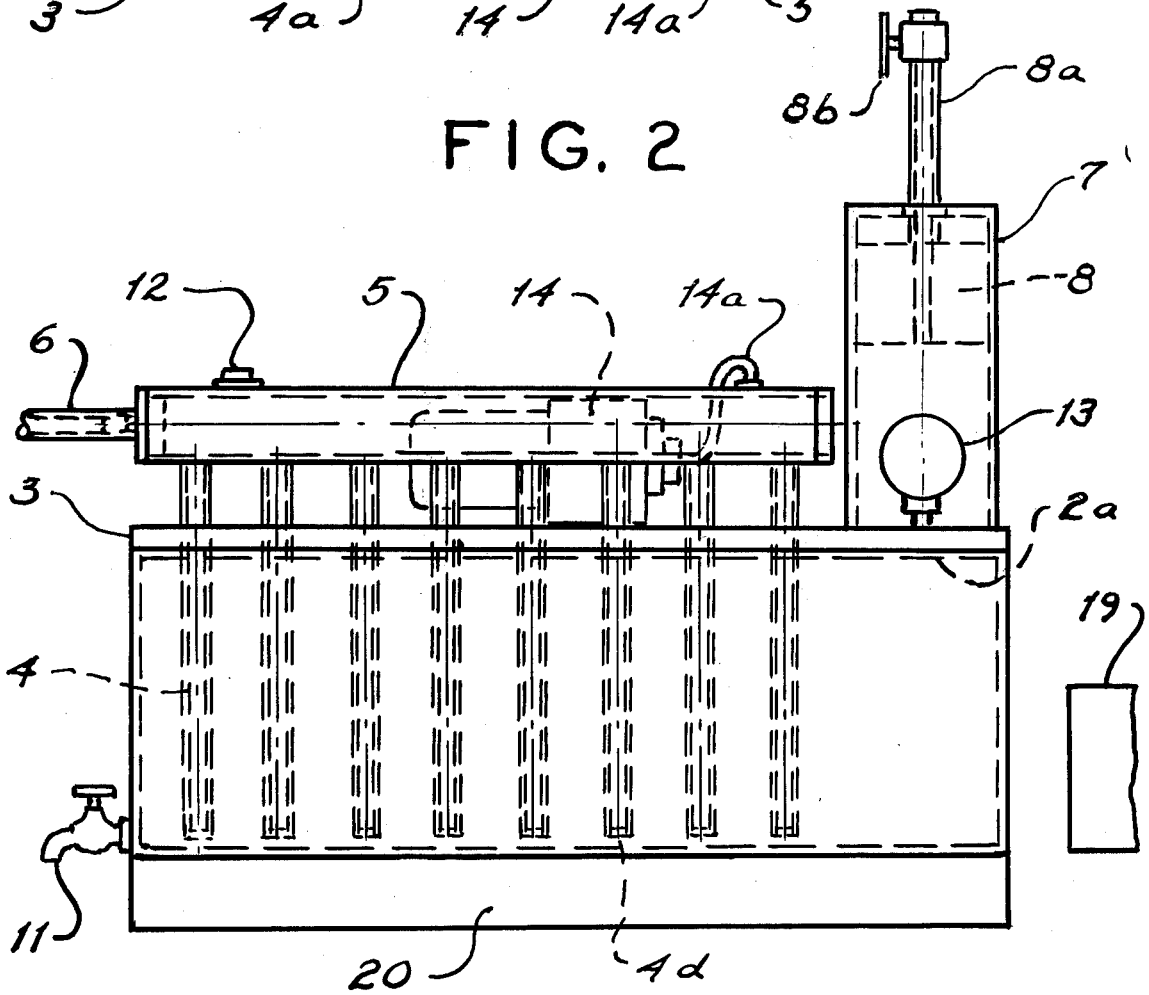
FIG. 2 is a side elevation view of the advanced Pressure-Electrolysis Cell -Unit.
Figure 3:
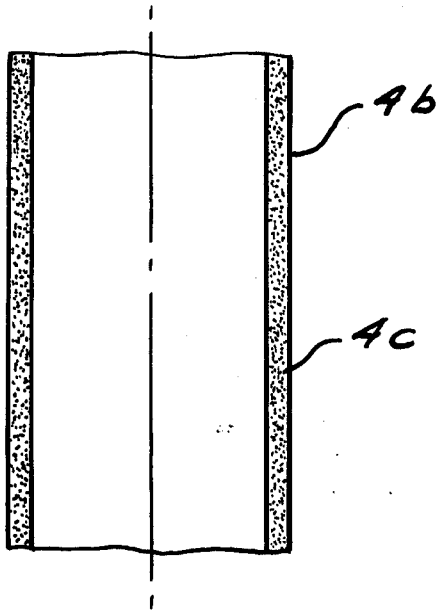
FIG. 3 is an enlarged cross-section view through a porous tubular electrode.
Figure 4:
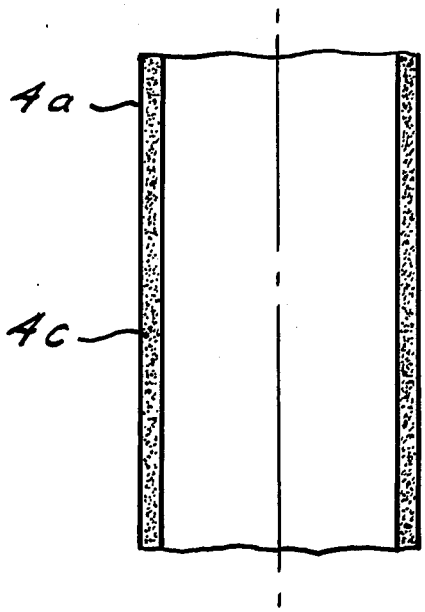
FIG. 4 is an enlarged cross-section view through an alternate porous tubular electrode.
Figure 5:
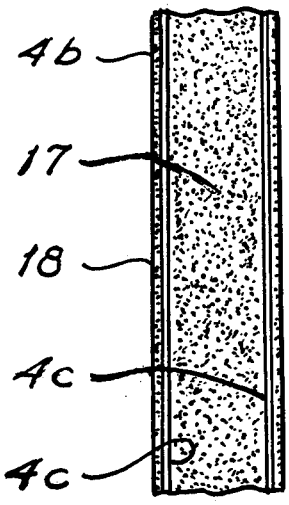
FIG. 5 is an enlarged cross-section view through a wall section of a porous tubular electrode.
Figure 6:
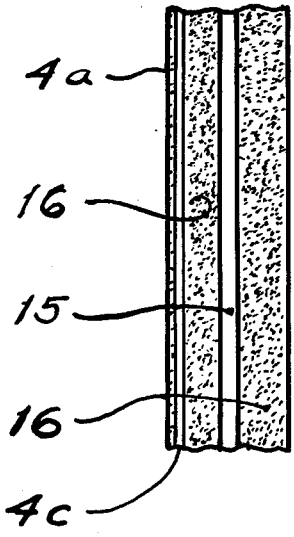
FIG. 6 is an enlarged cross-section view through an alternate wall section of a porous tubular electrode.

The advanced pressure electrolysis cell/-unit 1, consists of a rectangular process tank 2, which has a top flange **2*a***, around the top periphery.

A top insulation plate 3, is secured to the top flange 2*a*, and seals the tank from spillage by means of standard hardware fastening means.

Sets of porous tubular electrodes 4, are divided into anode-(oxygen passage) tubes 4*a*, and cathode-(hydrogen passage) tubes 4*b*, which are closely fitted into uniform holes within the top insulation plate 3, in a uniform rectangular pattern.

The sets of anode tubes 4*a*, and cathode tubes 4*b*, are lined up in opposite rows, so that the normal electrolysis process is facilatated, with a space not exceeding one - tenth of an inch between the bottom of the anode tubes 4*a*, and cathode tubes 4*b*, and the top of the inside surface of the rectangular process tank 2. Each electrode tube 4*a*, and 4*b*, is securely bonded to the top insulation plate 3, so that each tube extends into the process tank 2, close to the bottom surface, and above the top insulation plate 3, for external gas connection.

The porous tubular electrodes 4, are treated with a sub-surface layer of hydrophobic material 4*c*, so that water/electrolyte leakage is prevented, or minimized.

Two identical horizontal manifold tubes 5, are closely fitted over the sets of anode tubes 4*a*, and cathode tubes 4*b*, for the collection of the oxygen and hydrogen gases, respectively.

One end of each horizontal manifold tube 5, is sealed, while the other end is provided with a tube plug 5*a*, for connection to the gas application or load, by means of tubing lines 6.

A vertical cylinder 7, is secured and sealed at one end of the top insulation plate 3, which contains a movable piston-weight 8.

A vertical extension tube 8*a*, protrudes from the top of the piston-weight 8, which provides a means for replenishing the process tank 2, when necessary.

A shut-off valve 8*b*, is located within the extension tube 8*a*, for closing off the fluid flow, when the unit is not being filled.

The process tank 2, may be reenforced with layers of fiberglas/epoxy and steel members, if necessary to withstand higher operating pressures.

Electrical connections from the power source are made to the terminal block 9, with electrical leads 10, connected to each of the anode tubes 4*a*, and cathode tubes 4*b*, so that the correct electrical polarity is maintained for the porous tubular electrode sets.

A drain petcock 11, or other suitable draining means is built into the lower side wall of the process tank 2, for servicing the unit, and for periodic reverse-flushing.

A fluid entrance connection 12, is located on the top of one of the horizontal manifold tubes 5, to facilitate periodic reverse-flushing of the porous tubular electrodes 4.

A pressure gauge 13, is fitted and sealed into the top insulation plate 3, to monitor the process tank operating pressure level.

A small, self-contained-motor driven air pump 14, is mounted on the top insulation plate 3, to be used only when the periodic reverse-flushing of the porous tubular electrodes 4, is required.

Connection tubing lines, 14*a*, connects the air pump 14, with the top of the horizontal manifold tubes 5, to provide air pressurization of the distilled-flushing water.

An alternate arrangement for the anode tubes 4*a*, for oxygen passage would consist of the addition of a thin silicone rubber tube 15, which is closely located between two thin porous anode tubes 16. Plugs 4*d* seal the bottoms of each porous tube 4.

An alternate arrangement for the cathode tubes 4*b*, for hydrogen passage would consist of a dual hydrophobic coating 4*c*, on both the outside diameter and inside diameter of each cathode tube 4*b*, with the inclusion of fluid silicone 17, sealed in between the two subsurface hydrophobic coating layers, 4*c*.

An optional outer, anti-clogging treatment for the cathode tubes 4*b*, would be an outside film layer of palladium-black 18, not to exceed 0.0015 in thickness.

A low-voltage, D. C. power supply which provides between 2 and 3 volts, 19, is referred to, as a supporting component to the advanced pressure-electrolysis cell-/unit, 1 which consists of fixed or variable transformer and four diode bridge rectifiers of suitable capacities.

A low-frequency, low-amplitude vibration unit 20, is positioned and secured directly under the rectangular process tank 2, for the agitation of the caustic electrolyte with the tank.

The casing for the vibration unit 20, matches the rectangular size of the rectangular process tank 2, so that the unit assembly is stabilized in operation.

What is claimed:

1. An advanced pressure electrolysis cell and unit comprising a sealed rectangular process tank containing a top insulation plate, securing and sealing means for said sealed rectangular process tank and said top insulation plate, multiple equal sets of anode and cathode porous tubular electrodes uniformly secured and sealed at right angles within said top insulation plate, each set comprising one anode and one cathode, a sub-surface plastic hydrophobic layer uniformly disposed over each of said multiple equal sets of anode and cathode porous tubular electrodes, two horizontal gas manifold tubes secured and sealed to the tops of each said multiple equal sets of anode and cathode porous electrodes, one of said manifold tubes being sealed to the anodes and the other of said manifold tubes being sealed to the cathodes, sealing means uniformly provided for each of said multiple equal sets of anode and cathode porous tubular electrodes between said top insulation plate and said two horizontal gas manifold tubes.

plug sealing means at one end of said two horizontal gas manifold tubes, sealing and gas connection plugs secured to the opposite ends of said two horizontal gas manifold tubes, tubing connection means disposed between said two sealing and gas connection plugs and the hydrogen and oxygen gas application use, a vertical cylinder secured and sealed at one end of said top insulation plate in fluid communication with said sealed rectangular process tank, a vertically movable piston-weight closely fitted within said vertical cylinder secured and sealed at one end of said top insulation plate, a vertical extension tube centrally located within said vertically movable piston-weight, a fluid control valve located at the top of said vertical extension tube, a drain petcock built into the lower side of said sealed rectangular process tank, a pressure gauge fitted and sealed into said top insulation plate, electrical connections from an external low-voltage D. C. power supply source to a terminal block secured to the top of said top insulation plate, insulated electrical connection leads from the positive and negative terminals on said terminal block to the tops of each of said multiple equal sets of anode and cathode porous tubular electrodes-respectively.

2. The advanced pressure electrolysis cell and unit according to claim 1, wherein the said multiple equal sets of anode and cathode porous tubular electrodes are made of pure sintered nickel metal with a porosity rating of between 0.3 microns and 5. microns for the cathode porous tubular electrodes and between 1 micron and 10 microns for the anode porous tubular electrodes, the said sub-surface plastic hydrophobic layer uniformly applied to each of said multiple equal sets of anode and cathode porous tubular electrodes is tetrafluoroethylene, the disposing of each of said multiple equal sets of anode and cathode porous tubular electrodes within approximately one-tenth of one inch from the inside bottom surface of said sealed rectangular process tank, close spacing of said multiple equal sets of anode and cathode porous tubular electrodes within said sealed rectangular process tank for high density concentration of one electrode per two inches of said sealed rectangular process tank length.

3. The advanced pressure electrolysis cell and unit of claim 1, in which a fluid reverse-flushing connection means is located on the top of two of the said two horizontal gas manifold tubes, distilled water supply means to said fluid reverse-flushing connection means, motor driven air pump mounted on the top of said top insulation plate, a compressed air tubing connection means disposed between said fluid reverse-flushing connection means and said motor driven air pump.

4. An advanced pressure electrolysis cell and unit comprising a sealed rectangular process tank containing a top insulation plate, securing and sealing means for said sealed rectangular process tank and said top insulation plate, multiple equal sets of anode and cathode porous tubular electrodes uniformly secured and sealed at right angles within said top insulation plate, each set comprising one anode and one cathode, sub-surface plastic hydrophobic layers disposed on both the outside and inside diameters of each of said multiple equal sets of anode and cathode porous tubular electrodes, an inclusion volume of fluid silicone sealed in between said sub-surface plastic hydrophobic layers disposed on both the outside and inside diameters of each of said multiple equal sets of anode and cathode porous tubular electrodes, an outer final thin film of palladium-black is formed on the outside diameters of the multiple sets of cathode porous tubular electrodes, two horizontal gas manifold tubes secured and sealed to the tops of each said multiple equal sets of anode and cathode porous electrodes, one of said manifold tubes being sealed to the anodes and the other of said manifold tubes being sealed to the cathodes, sealing means uniformly provided for each of said multiple equal sets of anode and cathode porous tubular electrodes between said top insulation plate and said two horizontal gas manifold tubes, plug sealing means at one end of said two horizontal gas manifold tubes, sealing and gas connection plugs secured to the opposite ends of said two horizontal gas manifold tubes, tubing connection means disposed between said two sealing and gas connection plugs and the hydrogen and oxygen gas application use, a vertical cylinder secured and sealed at one end of said top insulation plate in fluid communication with said sealed rectangular process tank, a vertically movable piston-weight closely fitted within said vertical cylinder secured and sealed at one end of said top insulation plate, a vertical extension tube centrally located within said vertically movable piston-weight, a fluid control valve located at the top of said vertical extension tube, a drain petcock built into the lower side of said sealed rectangular process tank, a pressure gauge fitted and sealed into said top insulation plate, a low-frequency, low-amplitude vibration unit positioned and secured under said sealed rectangular process tank, electrical connections from an external low-voltage D. C. power supply source to a terminal block secured to the top of said top insulation plate, insulated electrical connection leads from the positive and negative terminals on said terminal block to the tops of each of said multiple equal sets of anode and cathode porous tubular electrodes -respectively.

5. The advanced pressure electrolysis cell and unit according to claim 4, wherein the multiple sets of anode porous tubular electrode are fabricated as a single thin tube of silicone rubber sealed in between two thin porous tubular electrodes, the multiple sets of cathode porous tubular electrodes are made of pure vanadium metal.

6. The advanced pressure electrolysis cell and unit of claim 4, in which said sub-surface plastic hydrophobic layers disposed on both the outside and inside diameters of each of said multiple equal sets of anode and cathode porous tubular electrodes is high density polyethylene, an outer final thin film of palladium-black is formed on the outside of the multiple sets of cathode porous tubular electrodes.

7. The advanced pressure electrolysis cell and unit of claim 4, wherein the said sealed rectangular process tank is reenforced with fiberglas/epoxy and steel members on its interior and exterior surfaces, standard hardware securing and sealing means are utilized to assemble said advanced pressure electrolysis cell and unit.

8. The advanced pressure electrolysis cell and unit of claim 4, including a low-voltage D. C. power supply source as a unit part of said advanced pressure electrolysis cell and unit, transformer and rectifier means for connection to a standard household 110 volt A. C. power outlet as part of said low -voltage D. C. power supply source.

9. The advanced pressure electrolysis cell and unit of claim 4, including separate hydrogen and oxygen gas storage means in association with said tubing connection means disposed between said two sealing and gas connection plugs and the hydrogen and oxygen gas application use, venting to the atmosphere means for said oxygen gas storage means.

* * * * *